US005249891A

United States Patent [19]

Pecue, II

[11] Patent Number: 5,249,891

[45] Date of Patent: Oct. 5, 1993

[54] GUIDELINE SYSTEM FOR UNDERWATER OBSERVATION CAMERA SYSTEMS

[75] Inventor: William W. Pecue, II, Baton Rouge, La.

[73] Assignee: Texaco Inc., White Plains, N.Y.

[21] Appl. No.: 876,844

[22] Filed: Apr. 30, 1992

[51] Int. Cl.[5] ..... E21B 7/12

[52] U.S. Cl. ..... 405/191; 166/343

[58] Field of Search ..... 405/185, 188, 190, 191, 405/195.1, 224; 166/341, 342, 343

[56] References Cited

U.S. PATENT DOCUMENTS

| | | | |
|---|---|---|---|
| 3,517,737 | 6/1970 | Petersen | 166/343 |
| 4,214,842 | 7/1980 | Franks | 405/191 |
| 4,618,285 | 10/1986 | Ahlstone | 405/191 |
| 4,643,616 | 2/1987 | Castel et al. | 405/191 |
| 5,069,580 | 12/1991 | Herwig et al. | 405/191 |

*Primary Examiner*—David H. Corbin

*Attorney, Agent, or Firm*—James L. Bailey; Jack H. Park; Russell J. Egan

[57] ABSTRACT

An apparatus for guiding camera systems and the like subsea from a platform has a running tool and a guideline holder. These components are detachably assembled and the first runs and retrieves the second which connects guidelines to some fixed subsea point.

2 Claims, 2 Drawing Sheets

GUIDELINE SYSTEM FOR UNDERWATER OBSERVATION CAMERA SYSTEMS

BACKGROUND OF THE INVENTION

1. The Field of the Invention

The present invention relates to a method and apparatus providing a guidance system for an underwater observation camera system.

2. Prior Art

In the past, when an observation camera system was required for underwater work below a platform, the usual means of visual contact involved using a ROV (Remote Operated Vehicle). Not only are these submarines very expensive to operate underwater, but they are also fairly delicate machines. This often leads to extended operational downtime of the ROV due to repairs and required maintenance. Another risk that comes with using a ROV for observation below a platform is the possibility of the vehicle becoming entangled in one of the many levels of piping which form the platform jacket structure.

Several years ago it was proposed to use a conventional guideline camera system instead of the usual ROV for observation during a subsea tieback operation (to a platform). The operator (platform owner) had planned to provide a conduit from the platform deck to the subsea wellhead at the mudline by using a pre-installed conductor pipe. The top of the conductor pipe extended to the platform deck above the waterline, but the bottom of the conductor pipe stopped some distance (approximately 50 feet) above the underwater wellhead. A camera system was run inside the pre-installed conductor down to the bottom of the pipe and positioned to observe operations at the wellhead. A significant shortcoming of this design is that the operator was unable to observe at any levels except those below the bottom of the conductor pipe. On deepwater platforms, it is equally important to observe the entry of tools at every guide level in addition to making observation at the wellhead.

SUMMARY OF THE INVENTION

The present invention is particularly useful for a subsea tieback operations, similar to the one mentioned above, by providing a means to utilize a conventional guideline camera system that can make observations at substantially any level. Thus the observation window can span from the platform deck above the waterline to the subsea wellhead hundreds of feet underwater.

BRIEF DESCRIPTION OF THE DRAWINGS

The present invention will now be described by way of example, with reference to the accompanying drawings in which.

BRIEF DESCRIPTION OF THE INVENTION

The platform guideline system of the present invention consists of two main components, a running tool 10, which is used to run and retrieve the second piece of equipment, and a guideline holder 12, which connects the guidelines to some fixed point under the platform.

Figure 1:
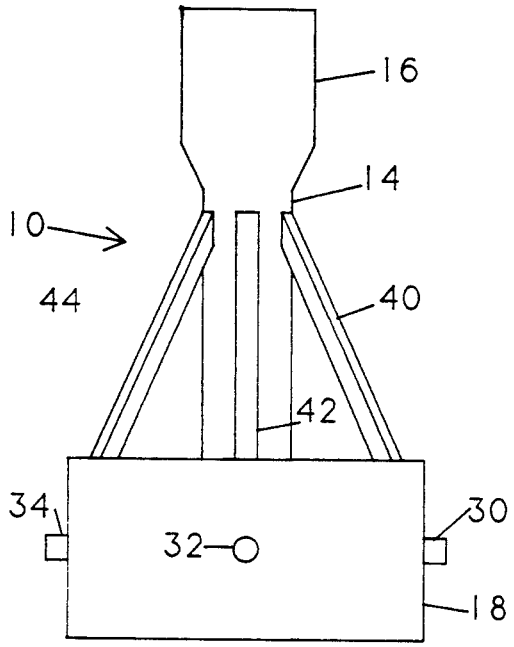
FIG. 1 is a side elevation of the subject running tool.
Figure 3:
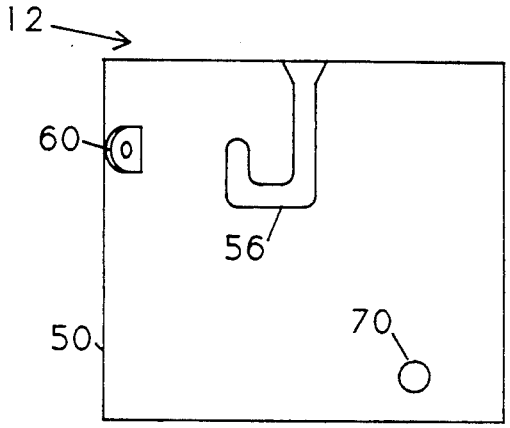
FIG. 3 is a side elevation of the subject guideline holder.
Figure 2:
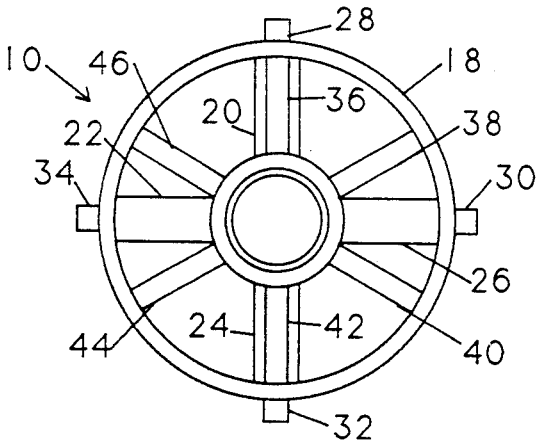
FIG. 2 is a top plan view of the subject running tool.
Figure 4:
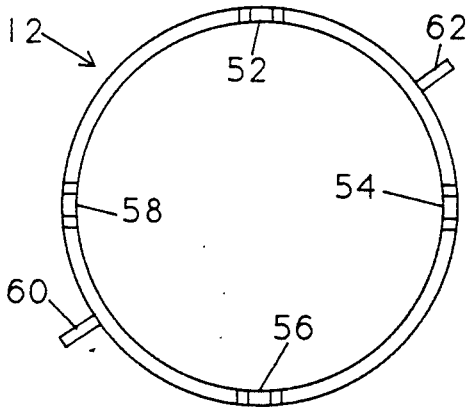
FIG. 4 is a top plan view of the subject guideline holder.
Figure 5:
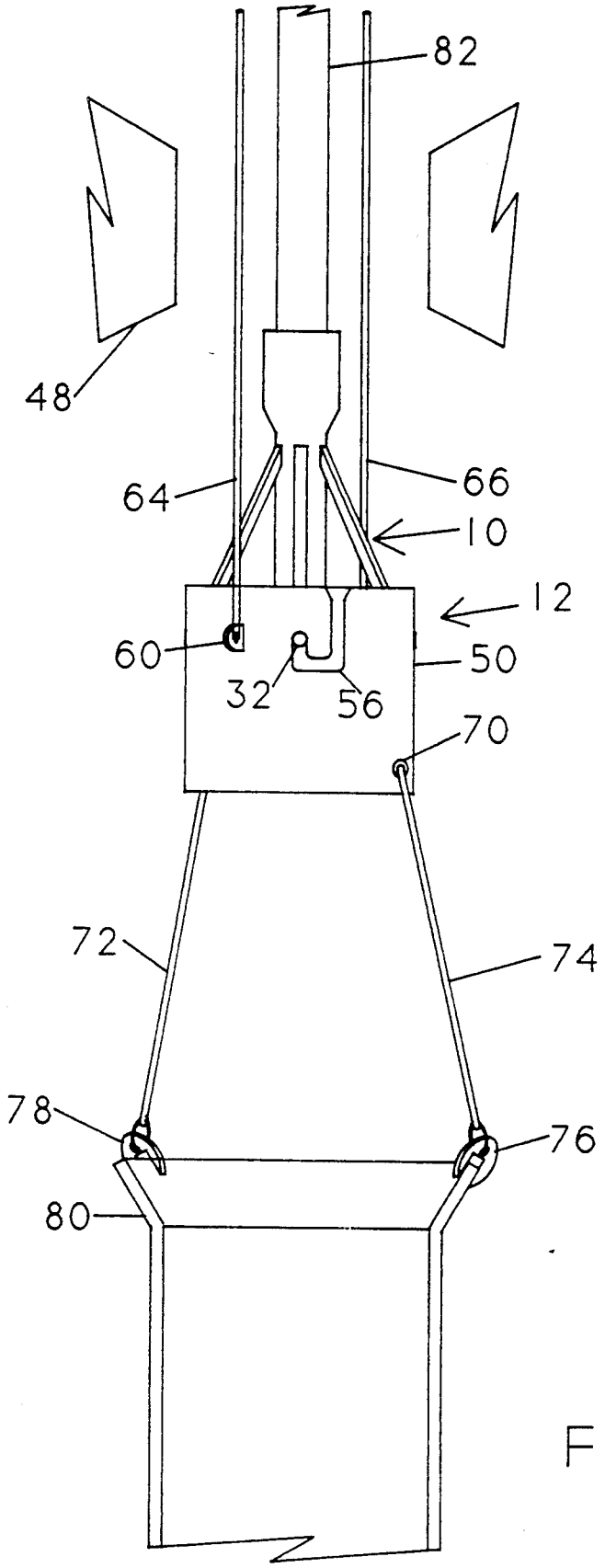
FIG. 5 is a side elevation, partly in section, showing the operation of the present invention.

The running tool 10 simply provides a means for running and later retrieving the guideline holder 12. It is also used as a mechanism to create an upward pull on the guideline holder 12. The running tool 10 consists of a short section of drillpipe 14. The top end of this section 14 has a drillpipe connection 16 while the bottom end of the section is plain-ended pipe. The bottom of this drillpipe section is held centered inside a short large diameter cylinder 18 by cross brackets 20, 22, 24, 26. The drillpipe section 14 is welded in place such that its bottom end is flush with the cross brackets at the bottom of the cylinder 18. Extending off the external surface of the short cylinder 18 are four lugs 28, 30, 32, 34. Each lug is mounted midway (in height) on the short cylinder 18 with the projections spaced 90 degrees apart. Extending from the top-inside of the short cylinder are six brace members 36, 38, 40, 42, 44, 46. These brace members are attached, at their lower ends, to the inside of the cylinder 18 spaced approximately 60 degrees apart. The upper ends of the brace members are attached to the drillpipe section 14 just below the connection 16. These brace members form a tapered profile that allows for easy retrieval of the running tool 10 (see FIG. 5) when it is pulled through the platform conductor guide levels 48.

The guideline holder 12 consists of a short large diameter cylinder 50 with an outer diameter slightly less than the internal diameter of the platform conductor guide levels 48. Its interior diameter is slightly larger than the outer diameter of the cylinder 18 of the running tool 10. Located on opposite sides of the top edge of this cylinder, are four slots 52, 54, 56, 58 each of which has a J-profile. The J-profile slots receive therein respective lugs of the holding tool 10 and serve to hold the two together during installation and removal of the system. This J-profile allows the guideline holder 12 to be run and retrieved using the running tool 10. Two padeyes 60, 62 are mounted on opposite (external) sides at the top of the cylinder 50. These padeyes form an attachment point for the guidelines 64, 66 to the cylinder 50 by use of conventional shackles (not shown). On the bottom of the cylinder are two bored holes 70. These holes are located at positions spaced 90 degrees from the two padeyes 60, 62. Attached to each of these two bored holes are slings 72, 74, that measure several feet in length. Positioning clamps 76, 78 are secured on the other end of the slings that secure the assembly to a metal lip 80 or mounting structure below the platform. The clamps 76, 78 are not shown in detail as they are similar to conventional clamps used for moving sheets of metal.

To use the subject platform-guideline system, the running tool 10 is inserted inside the guideline holder 12 and slightly rotated to the right so that the lugs 28, 30, 32, 34 of the running tool 10 engage in respective J-slots 52, 54, 56, 58 and are supporting the guideline holder 12. The two guidelines 64, 66 are attached to the padeyes 60, 62 at the top of the guideline holder 10 using conventional shackles (not shown). Next, the guidelines are pulled tight and attached to the top of the running tool 10 using any conventional means, such as tape. The platform guideline system can now be connected to a drillstring 82 and be run underwater through the various platform conductor guide levels 48 until it is positioned at the desired location.

An underwater diver or Remote Operated Vehicle (ROV) then approaches the guideline holder and positions the clamps 76, 78 onto the mating surface 80. After being properly positioned, the clamps are then activated to an engaged condition. An upward pull on the running tool 10 causes the clamps to engage the metal surface 80. After confirming that the clamps are holding and the slack has been taken out of the slings 72, 74 the guidelines 64, 66 can be pulled taut from the surface. The final installation step involves securing the taut guidelines to an overhead point through the use of turnbuckles (not shown). The guidelines are then ready to accept the underwater camera system (also not shown) for lowering down the guidelines to an observation position.

The procedure for disconnecting the subject platform-guideline system is the reverse of the above described process.

If the platform or template is designed with the proper mating equipment, the clamps can be substituted with ROV-Assist Pin/Release mechanisms.

The present invention may be subject to many modifications and changes without departing from the spirit or essential characteristics of the present invention as defined by the appended claims. The present embodiment should therefor be considered in all respects as being illustrative rather than restrictive of the scope of the invention.

I claim:

1. An apparatus for guiding lines from the surface to a fixed subsea object comprising:

a running tool depending from the lower end of a pipe string and having first and second cylindrical members;

said first cylindrical member having drill pipe connection means on a first end thereof;

a second cylindrical member having a larger diameter and positioned coaxially with respect to said first cylindrical member;

means at the second end of said first cylindrical member and like end of said second cylindrical member fixedly securing said cylindrical members together;

brace members connected between said first and second cylindrical members forming a generally upwardly directed inwardly tapering, conical configuration assuring the coaxial assembly of said first and second cylindrical members;

a guideline holder having first means for attachment to a fixed subsea object and second means for attachment to guidelines depending from the surface; and outwardly directed stud means on said second cylindrical member adapted to engage said guideline holder to detachably assembly said running tool and said guideline holder together.

2. An apparatus according to claim 1 wherein said guideline holder comprises:

a cylindrical member having at least two oppositely mounted pad eyes fixed to the outer surface thereof and forming said second attachment means;

J-shaped slot means positioned to receive therein stud means of said running tool to secure said tool and said holder together; and means suspended from said member and forming said first attachment means to engage said fixed subsea object.

* * * * *